United States Patent [19]

Brombach

[11] 4,206,783

[45] Jun. 10, 1980

[54] VORTEX CHAMBER VALVE

[76] Inventor: Hansjöerg Brombach, Kirchbergstrasse 37, D-6990 Bad Mergentheim, Fed. Rep. of Germany

[21] Appl. No.: 882,705

[22] Filed: Mar. 2, 1978

[30] Foreign Application Priority Data

Mar. 22, 1977 [DE] Fed. Rep. of Germany ..... 2712443

[51] Int. Cl.[2] ..... F15C 1/16

[52] U.S. Cl. ..... 137/810; 137/808; 137/813

[58] Field of Search ..... 137/806, 808, 810, 812, 137/813

[56] References Cited

U.S. PATENT DOCUMENTS

| | | | |
|---|---|---|---|
| 3,219,048 | 11/1965 | Palmisano | 137/813 |
| 3,731,699 | 5/1973 | Hallum | 137/810 X |
| 3,958,723 | 5/1976 | Stahle | 137/810 X |
| 4,091,716 | 5/1978 | Ryan | 137/810 X |

FOREIGN PATENT DOCUMENTS

| | | |
|---|---|---|
| 2035580 | 4/1971 | Fed. Rep. of Germany . |
| 2431112 | 1/1976 | Fed. Rep. of Germany . |

*Primary Examiner*—William R. Cline

*Attorney, Agent, or Firm*—Steele, Gould & Fried; Steele, Gould & Fried

[57] ABSTRACT

A substantially funnel-shaped vortex chamber valve having a longitudinal axis assuming an angle to the vertical which is greater than 30°, having at least one substantially tangential inlet nozzle disposed in the vicinity of the lowest point of the largest cross-sectional area of the chamber, and an eccentrically arranged venting port disposed in the vicinity of the highest point of the chamber, the venting port having a feedline extending above the level of the head race.

26 Claims, 21 Drawing Figures

VORTEX CHAMBER VALVE

BACKGROUND OF THE INVENTION

1. Field of the Invention

The invention relates to the field of vortex chamber valves for liquids in general, and in particular, to such a valve having a vortex chamber, at least one inlet nozzle which issues substantially tangentially into the chamber and one substantially central outlet nozzle.

2. Prior Art

Compared with conventional types of valves, vortex chamber valves have the advantage of operating without moving mechanical parts. Due to the fact that they are essentially free from wear and maintenance they provide an extremely high operating reliability. Due to these advantages they are used where it is necessary to control fluids which are difficult to handle and where extreme conditions are placed on the operational reliability. Fluids which are difficult to handle are corrosive, radioactive or hot gases or liquids used in chemical and physical processes, as well as sewage and sludge conveying contaminants and fibrous materials. A high operational reliability is particularly required, for example, in the protection and operation of nuclear power stations. In hydraulic structures the automatic control of discharges and runoffs from storage basins, flood basins, settling tanks and the like requires valves which are able to reliably start operating after being shut down for many years and carry away very coarse contaminants.

Special vortex chamber valves have been developed for use in hyraulic structures which are able to operate with very small control pressures (low pressure valves). These valves make it possible to branch off the control pulse from the main stream or flow to be controlled. Hitherto two types of such valves have been developed to a level permitting their practical use, namely radial vortex chamber valves or radial amplifiers (cf DOS No. 2 035 580) and axial vortex chamber valves or axial amplifiers (cf German Pat. No. 2 431 112).

If only the supply current flows with respect to the valves a relatively loss-free lowering flow takes place. If in addition a flow is passed through the tangential control nozzle a momentum is imparted to the fluid in the chamber which leads to a helical flow. This helical flow leads to the velocity of the flow being greatly increased towards the outlet, which in turn causes centrifugal forces so that the flow through the valve is greatly constricted. With a slight control overpressure, the supply flow can be virtually stopped. The valves function in a flow-increasing manner if a control flow simultaneously acts on tangential control nozzles which are oppositely directed in pairs. The vortex formed when action takes place on only a single nozzle is blown down again by the second nozzle.

However, both the radial valve and the axial valve have certain qualities which restrict their use under certain conditions. The disadvantage of the radial valve is that eddies are formed in the vortex chamber even without a control flow and these produce pressure losses and reduce the throughflow. Thus, limits are placed on the control range or efficiency of the valve. Due to the uniform annular axial feed for the supply flow in the case of axial amplifiers, asymmetrical flow states no longer occur, so that a very uniform sink flow is obtained without a control flow. Thus, the pressure losses are smaller than with the radial amplifier. However, compared with a tubular control nozzle, the annular construction thereof increases the danger of clogging or blockage if liquids with coarse impurities are to be passed through the valve.

SUMMARY OF THE INVENTION

A principal object of the present invention is to provide a vortex chamber valve or amplifier which is simply constructed, which permits a nearly loss-free through-flow in the uncontrolled state, which is virtually unblockable and which can be controlled with a high level of efficiency.

According to the invention this object is accomplished in that the vortex chamber is constructed in funnel-shaped manner, the longitudinal axis of the vortex chamber assumes an angle to the vertical which is greater than 30°, all the liquid inlet nozzles are constructed as substantially tangential inlet nozzles, at least one inlet nozzle issues into the chamber in the vicinity of the lowest point of the largest cross-sectional area and in the vicinity of the highest point the chamber has an eccentrically arranged venting port whose feed line extends to above the level of the head race.

In the case of the vortex chamber according to the invention which is particularly intended for controlling the flow of liquids, the earth's gravitational force is utilised as a control quantity. Thus, no radial supply nozzles are necessary. In fact, a single tangential inlet nozzle is sufficient for operating the valve. Thus, the construction of such a vortex chamber valve can be made very simple, unless a plurality of tangential inlet nozzles are required for obtaining special control curves. The vortex chamber according to the invention is constructed in funnel-shaped manner, so that the liquid stream entering the widest point of the chamber is received by the funnel and passed into the outlet nozzle.

The vortex chamber axis is inclined by at least 30° out of the vertical, so that the liquid stream entering the chamber through the tangential inlet nozzle is deflected upwards by the upwardly sloping chamber wall facing the inlet nozzle. If there is only a limited liquid pressure at the inlet nozzle, the liquid rises only slightly on the chamber wall and is deflected in a curved manner towards the outlet nozzle. As a function of the liquid pressure in the chamber a partial filling with a free liquid level is formed. As the liquid rises further in the chamber air can escape through the upper eccentric venting port or in the case of a vacuum, can be sucked into the chamber. Initially the tangential momentum of the inflowing stream of liquid is not sufficient to start the formation of a vortex counter to the incomplete filling of the chamber. Thus, the liquid overflow from the chamber takes place at an increasing velocity as a function of the chamber filling level. The higher the inlet pressure in the tangential inlet nozzle, the more complete the filling of the chamber. Just before the chamber becomes full, the vortex commences. As a result of the behaviour of the vortex, the flow losses increase overproportionally with a rising inlet pressure, so that the flow quantity through the chamber drops relatively abruptly.

The vortex chamber, with its longitudinal axis, is preferably set up in such a way that the lowest surface line is located in the horizontal line.

In longitudinal section the vortex chamber is preferably substantially triangular, whereby a lower angle or corner is truncated and passes into the outlet nozzle.

The vortex chamber face facing the outlet nozzle is preferably formed by a flat plate which can be constructed to be removable. A portion of constant cross-section, particularly a flat cylindrical portion, can serve as an extension to the chamber between the funnel-shaped or conical portion and the chamber face. The inlet nozzle can issue into the chamber through the outer casing of the chamber, and in particular, through the portion which extends the same, or through the face thereof. In the latter case the inlet nozzle is preferably inclined towards the face of the chamber. By special shaping of the vortex chamber the partial filling zone of the chamber which precedes vortex formation can be varied. By varying the cone angle of the conical vortex chamber the control can be influenced by the valve. Thus, a vortex chamber with a cone angle of only approximately 45° has an increased suction force in the uncontrolled state due to the venturi action of the outlet area. In addition, the flow losses for the uncontrolled liquid stream can be kept very small by ensuring a minimum deflection of the liquid flow in the uncontrolled state between the inlet nozzle and the outlet nozzle. This can be achieved by a correspondingly inclined position of the inlet nozzle and/or outlet nozzle relative to the vortex chamber. The inlet nozzle can issue into the chamber in a clockwise or anticlockwise direction.

The vortex chamber valve according to the invention can be controlled in various ways. Generally control takes place as a function of the energy level at the tangential inlet nozzle. However, it can also be performed as a function of the dynamic pressure and as a function of the liquid filling level in the tail race, even if the liquid pressure in the inlet nozzle is kept constant. Further, it is also possible to vary the control as a function of the gas pressure in the air line leading to the upper venting port. Thus, by closing the air line as a function of the liquid level in the head race or tail race a vacuum can be formed in the vortex chamber which leads to a rapid rise in the filling level in the vortex chamber and consequently an earlier commencement of the vortex in said chamber. An externally acting remote pneumatic control of the valve can be achieved by suctional removal or topping up the air cushion in the vortex chamber.

BRIEF DESCRIPTION OF THE DRAWINGS

Further features of the invention can be gathered from the following description of embodiments in conjunction with the drawings and claims. The description of the individual embodiments relates to water as the liquid. However it is pointed out that the constructions apply equally well to other liquids. The diagrammatic drawings show:

DETAILED DESCRIPTION

Figure 1:
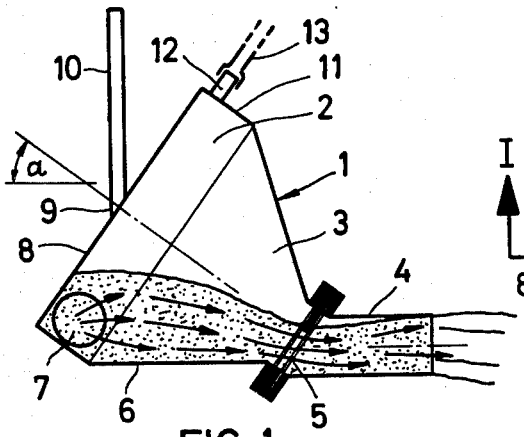
FIG. 1 is an embodiment of the invention in cross-section in the uncontrolled state.
Figure 2:
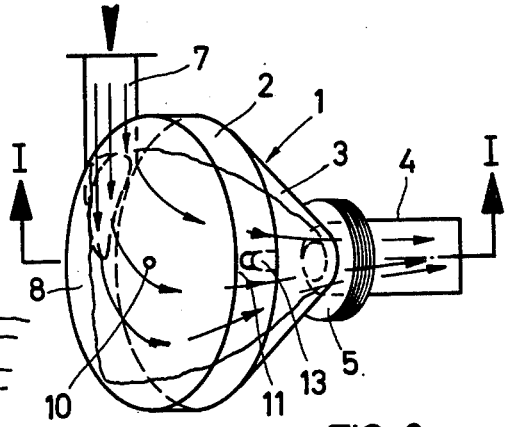
FIG. 2 is a plan view of the embodiment of FIG. 1.
Figure 3:
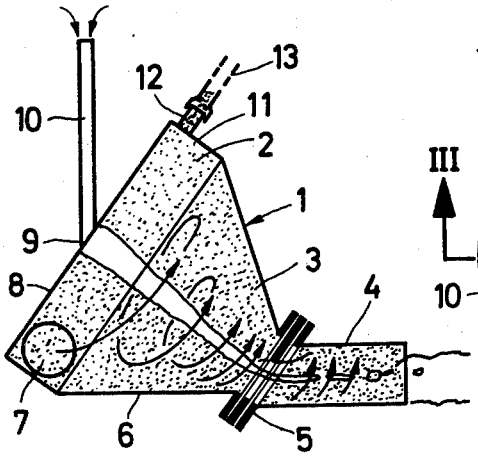
FIG. 3 is a section through the embodiment of FIG. 1 in the controlled state.
Figure 4:
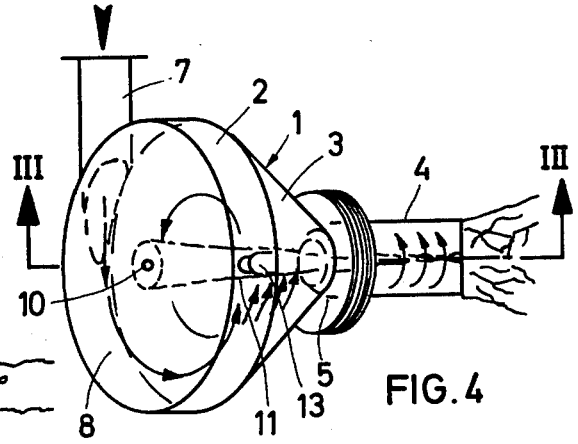
FIG. 4 is a plan view of the embodiment of FIG. 3.

In the embodiment of the invention shown in FIGS. 1 to 4, a conical vortex chamber 1 is provided, formed by a flat cylindrical section 2 and the frustum-shaped section 3. The flat cylindrical section 2 is located on the point of frustum 3 with the largest diameter. The frustum-shaped section passes in funnel-shaped manner into an outlet nozzle 4 constructed in tubular form. A diaphragm 5 is located at the transition between the frustum-shaped section and the outlet nozzle 4.

The cone angle $2\alpha$ is 72° in the present embodiment. The ratio of the cylinder height of the cylindrical section 2 to the height of the frustum 3 is approximately 1:2.5. The longitudinal axis of the axially symmetrical vortex chamber 1 is inclined by an angle of 54° to the vertical. This angle is equal to $90° - \alpha$, so that the lowest surface line 6 of frustum 3 is horizontal. Diaphragm 5 is perpendicular to the vortex chamber axis. Outlet nozzle 4 is positioned horizontally and is slightly downwardly displaced parallel to the lower surface line 6. An inlet nozzle 7 which constitutes the only inflow for water into the vortex chamber issues tangentially and horizontally into the lowest point of cylindrical section 2. Inlet nozzle 7 has the same internal diameter as outlet nozzle 4. The diameter of inlet nozzle 7 also substantially corresponds to the height of cylindrical section 2. The top of face 8 of vortex chamber 1 facing outlet nozzle 4 is formed by a flat removable cover having a central venting port 9 from which passes upwards a tube 10 and projects at least above the apex of chamber 1. An eccentric venting port 12 from which a tube 13 extends to above the level of the head race is provided on the outer casing 11 of cylindrical section 2 at the highest point thereof.

In the case of the embodiment of a vortex chamber valve shown in FIGS. 1 to 4 gravitational force acting on the water is used as a control quantity, so that a single inlet nozzle is sufficient. If a weak liquid flow passes into the chamber 1 through tubular inlet nozzle 7, said flow rises somewhat on the inner wall of the chamber facing nozzle 7 and is deflected in the direction of outlet nozzle 4, through which it leaves the chamber, by the conical wall of the chamber. The upper part of the vortex chamber remains essentially unfilled. A pressure compensation with the ambient air takes place through venting ports 9 and/or 12. If the flow of liquid through inlet nozzle 7 increases, the liquid filling level in chamber 1 rises, so that said level is somewhat higher on the side of the chamber facing inlet nozzle 7 than on the inner wall of the chamber adjacent to nozzle 7. At a particular filling level, the momentum of the flow which tangentially enters the chamber is sufficient to start up a vortex therein counter to the gravitational force on the water. The vortex is started in a sudden manner and causes an increased flow resistance, so that the pressure within the chamber rises and the latter is completely filled with liquid (See FIGS. 3 and 4). In the core of the vortex a vacuum is formed, but this is compensated by sucking air in through the central venting port 9 and tube 10. When the inlet pressure at inlet nozzle 7 drops the vortex collapses just as suddenly, but due to the lower velocities in the supply line this takes place at a somewhat lower inlet pressure than when it forms. The hysteresis characteristic is small.

The vortex chamber permits a control of the quantity of water flowing through the chamber without the aid of moving mechanical parts, solely as a function of the water pressure at inlet nozzle 7. By changing suitable diaphragm disks in diaphragm 5 the control quantity of vortex chamber 1 can be adapted in simple manner to the particular requirements.

Figure 5:
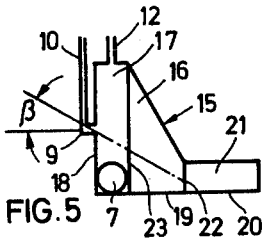
FIG. 5 is another embodiment in cross-section.
Figure 6:
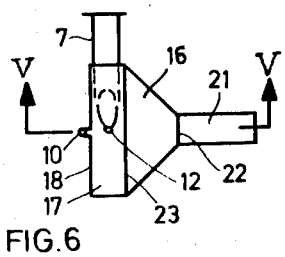
FIG. 6 is a plan view of the embodiment of FIG. 5.

In the following description of the remaining embodiments the same parts are given the same reference numerals. FIGS. 5 and 6 show an embodiment of a vortex chamber valve in which chamber 15, unlike chamber 1 of the preceding embodiment, is not constructed in an axially symmetrical manner. The funnel-shaped part 16 of the vortex chamber is now shaped like an inclined cone. The circular outer edge of the funnel-shaped part 16 forms a right angle with the lowest surface line 19 at the transition point 23 into section 17. In this case cover 18 is no longer perpendicular to the axis of the vortex chamber. The perpendicular line on cover 18 now forms an angle $\beta$ with the vortex chamber axis which becomes smaller with increasing chamber length and larger with increasing chamber height. The lower surface line 19 of funnel-shaped section 16 and the lower surface line 20 of outlet nozzle 21 are aligned with one another and are directed horizontally. Cover 18 the transition 22 from the funnel-shaped part 16 into outlet nozzle 21 corresponding to diaphragm 5 and the transition point 23 from the section with constant cross-section 17 into the funnel-shaped section 16 are in each case parallel to one another in the vertical plane and have a circular cross-section, in the same way as the flat cylindrical part 17.

Due to the inclined construction of the funnel-shaped part and the vertical arrangement of the face, vortex chamber 15 is higher than in the embodiment of FIGS. 1 to 4. Due to the relative increase in the chamber height compared with the chamber width the position of the changeover or reversing point can be modified. In the present embodiment the vortex starts later than in the embodiment of FIGS. 1 to 4.

Figure 7:
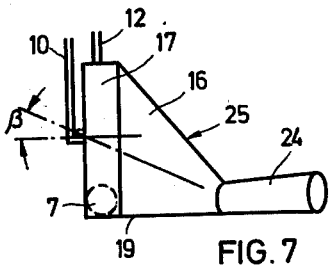
FIG. 7 is a further embodiment in side view.
Figure 8:
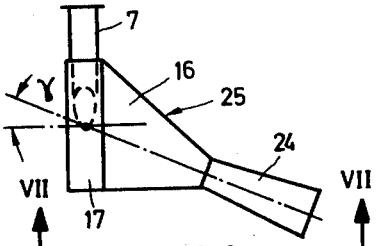
FIG. 8 is a plan view of the embodiment of FIG. 7.

The embodiment of FIGS. 7 and 8 differs from that of FIGS. 5 and 6 in that the axis of the vortex chamber to the perpendicular on the vertical chamber cover 18 is inclined in two directions. The projection of the chamber axis on a vertical plane forms an angle $\beta$ with the perpendicular on the chamber cover, as is the case in the embodiment of FIGS. 5 and 6. In addition, the projection of the chamber axis and the axis of outlet nozzle 24 forms an angle $\gamma$ with the perpendicular on chamber cover 18 on a horizontal plane. The chamber axis is thereby inclined in such a direction than an obtuse angle is formed between the projection of the chamber axis on a horizontal plane and the longitudinal axis of inlet nozzle 7. Thus, the flow of uncontrolled liquid through the vortex chamber 25 is subject to fewer losses and consequently the efficiency of the chamber for controlling the through-flow is increased. In addition, chamber 25 is higher than it is wide, whereby it can have a substantially elliptical cross-section and correspondingly section 17 with a constant cross-section. Due to this construction the vortex starts at an even higher filling level.

Figure 9:
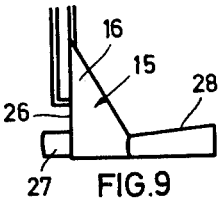
FIG. 9 is a side view of a further embodiment.
Figure 10:
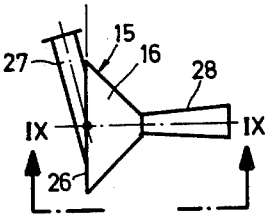
FIG. 10 is a plan view of the embodiment of FIG. 9.

In the case of the embodiment shown in FIGS. 9 and 10 the funnel-shaped part 16 of vortex chamber 15 is constructed in the same way as in FIGS. 5 and 6, namely with an inclined cone. A circular chamber cover 26 is located directly on the edge of the funnel-shaped section 16. Inlet nozzle 27 is inclined horizontally relative to the chamber axis and relative to cover 26 and issues through cover 26 into vortex chamber 15. Outlet nozzle 28 is widened in diffuser-like manner. Through inclining the axis of the inlet nozzle to the projection of the chamber axis, the same advantageous action is obtained as was described with reference to the embodiment of FIGS. 7 and 8. The obtuse angle between the "tangential" inlet nozzle and the projection of the chamber axis is advantageously approximately 105° to 120°.

Figure 11:
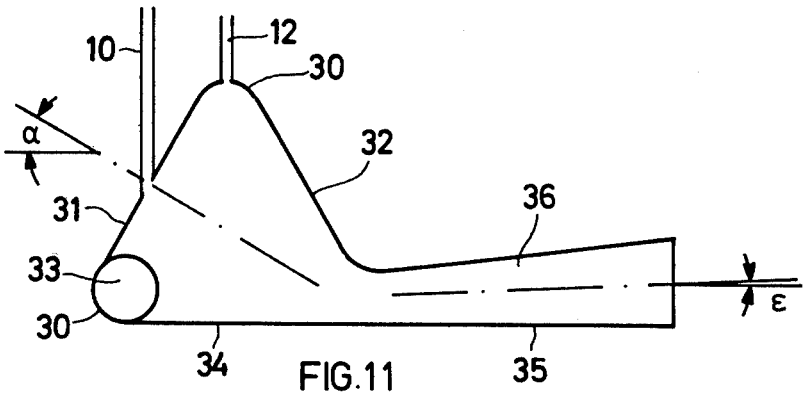
FIG. 11 is a further embodiment in cross-section.
Figure 12:
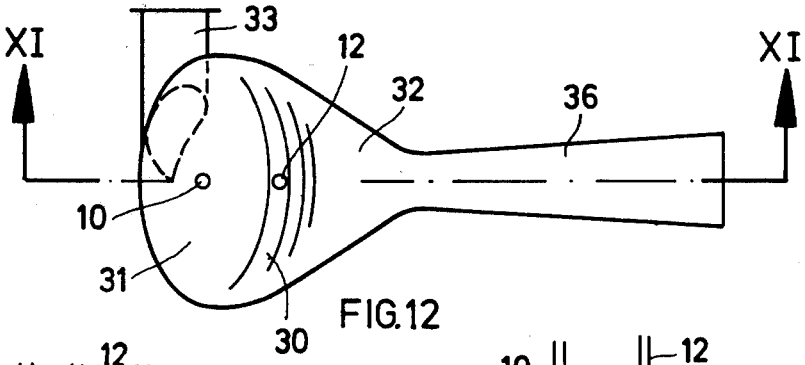
FIG. 12 is a plan view of the embodiment of FIG. 11.

In the case of the embodiment shown in FIGS. 11 and 12 cone angle $2\alpha$ is only 60°. The transition point 30 from the chamber cover 31 to the funnel-shaped section 32 is rounded and specifically in accordance with the radius of the tangential inlet nozzle 33, so that advantageous flow conditions are obtained. The lower surface line 34 of the funnel-shaped part 32 and the lower surface line 35 of outlet nozzle 36 are aligned with one another. Outlet nozzle 36 is widened in diffuser-like manner by an angle $\epsilon$ of approximately 4°. Due to the construction of the vortex chamber in a manner which is advantageous to the flow, air is sucked to an increasing extent through venting opening 12 in the uncontrolled operating state and is delivered through the outlet nozzle. Otherwise the embodiment of FIGS. 11 and 12 substantially corresponds to that of FIGS. 1 to 4.

Figure 13:
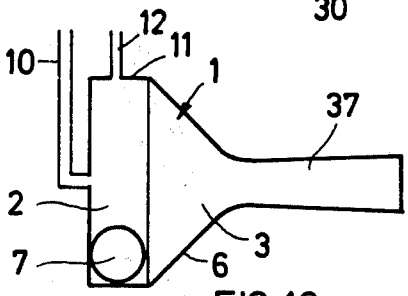
FIG. 13 is a further embodiment in cross-section.
Figure 14:
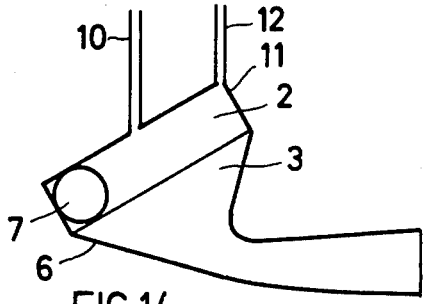
FIG. 14 is a further embodiment in cross-section.
Figure 15:
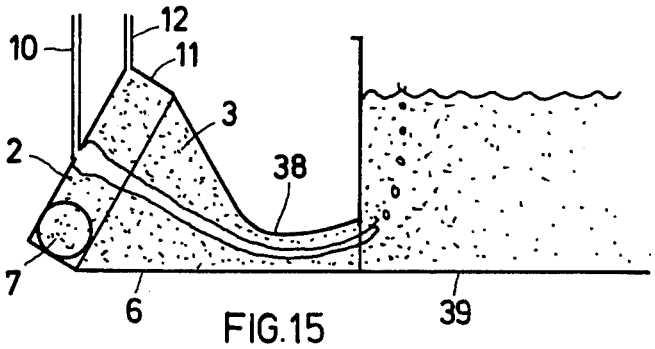
FIG. 15 is an embodiment in conjunction with a tail race tank in cross-section.

In the embodiment of the invention shown in FIG. 13 the vortex chamber axis has a horizontal configuration. Otherwise the vortex chamber is substantially constructed in the same way as in the embodiment of FIG. 1. Due to the fact that the vortex chamber axis runs horizontally the axes of the vortex chamber 1 and outlet nozzle 37 coincide. However, inlet nozzle 7 is now lower than outlet nozzle 37. The lower surface line 6 of vortex chamber 1 rises from the inlet nozzle 7 to outlet nozzle 37 with the pitch of half the cone angle. Due to the horizontal displacement of the vortex chamber axis the vortex starts closer to the pressure zero point. Thus, the vortex chamber amplifier acts in a sensitive manner to pressure changes at the inlet side and produces a large operating jump which corresponds to an abrupt amplifier setting. If the chamber axis is displaced out of the horizontal in the vertical direction, as indicated in FIG. 14, the pressure zero point and the starting point are moved apart.

If the chamber axis were located in the vertical position the operating jump would disappear completely. However, such a construction does not form part of the invention.

FIGS. 15 to 18 show different control possibilities for the vortex chamber as a function of the liquid level in the tail race or head race. The embodiment of FIG. 15 substantially corresponds to that of FIG. 1, however no interchangeable diaphragm is provided. Outlet nozzle 38 is widened in diffuser-like manner and issues into a collecting basin 39 for the lower race below the water level. In the case of a constant inlet pressure at inlet nozzle 7 the vortex chamber amplifier can be reversed by backpressure. If the tail race level rises above a desired mark the amplifier automatically reduces the water supply. Whereas in the embodiment of FIG. 15 the lower surface line 6 of chamber 1 is at the same level as the bottom of tail race tank 39 and can even be above the bottom of the latter in the embodiment of FIG. 18 an arrangement is provided in which chamber 1 is lower than tank 39. A long rising pipe 40 is provided between vortex chamber 1 and tail race tank 39 in which an intimate mixing and turbulence of the air and water is obtained, resulting in an effective oxygen charging of the water. Due to the mixing with air the liquid column in rising pipe 40 rises compared with the hydrostatic pressure in tail race tank 39. There is a tendancy in the core of the vortex in chamber 1 to form a high vacuum which is compensated by increased sucking in of air through the central venting port 9. This constitutes a special use of the vortex chamber.

Figure 16:
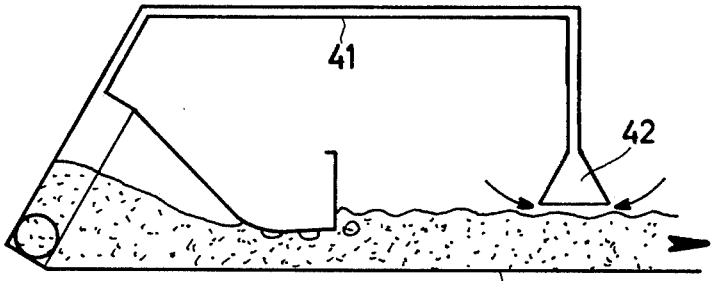
FIG. 16 is a cross-section through an embodiment with an external suction air connection to the surface of the tail race.
Figure 17:
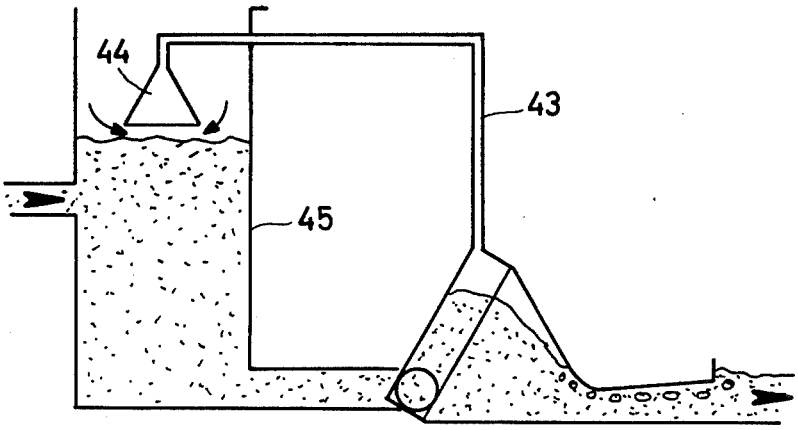
FIG. 17 is a cross-section through an embodiment with an external suction air connection to the surface of the head race.
Figure 18:
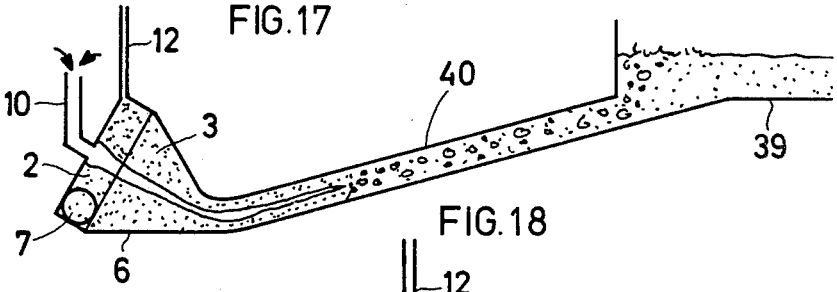
FIG. 18 is a cross-section through an embodiment with an air mixing tube for the tail race ventilation.

In the embodiments according to FIGS. 16 and 17 the vortex chamber valve is controlled as a function of the liquid level in the head or tail race. In this case no central venting port is provided. In the embodiment of FIG. 16 a rising pipe 41 passes from the eccentric venting port 12 of vortex chamber 1 to tail race tank 39 where it issues into a suction hood 42 widened in funnel-shaped manner at the tail race water level. The cone angle in this embodiment is extremely small, being 45°. The angle of inclination of the vortex chamber axis relative to the vertical is 67.5°. Due to the flat construction of the cone due to the air lift action the outflowing water entrains with it air and produces a vacuum in the chamber. If the tail race water level rises it closes suction hood 42 so that no more air can be sucked in. As a result the liquid level in chamber 1 rises and the vortex starts, so that the quantity of water flowing from the vortex chamber into tail race tank 39 is reduced. If the water level in the tail race tank drops to such an extent that air can pass through suction hood 42 and suction pipe 41 into vortex chamber 1 there is once again a pressure compensation with the external air. In the case of a correspondingly small liquid pressure in the inlet nozzle the liquid level in the vortex chamber drops so that the vortex collapses and the water flows in uncontrolled manner through the chamber into tail race tank 39. Suction pipe 41 must be guided in such a way that its apex is above the highest head race water level, so that on reversing the valve no lift action occurs in said line.

In the embodiment of FIG. 17 the vortex chamber valve is controlled by the head race water level. A suction pipe 43 which passes upwards from the eccentric venting port 12 issues into a suction hood 44 which terminates above the liquid level in the head race tank. On raising the liquid level up to hood 44 the air supply is interrupted by suction pipe 43, so that the vortex in the vortex chamber starts more easily than would otherwise be the case. However, the working range of the said head race control is limited to low head water levels.

Figure 19:
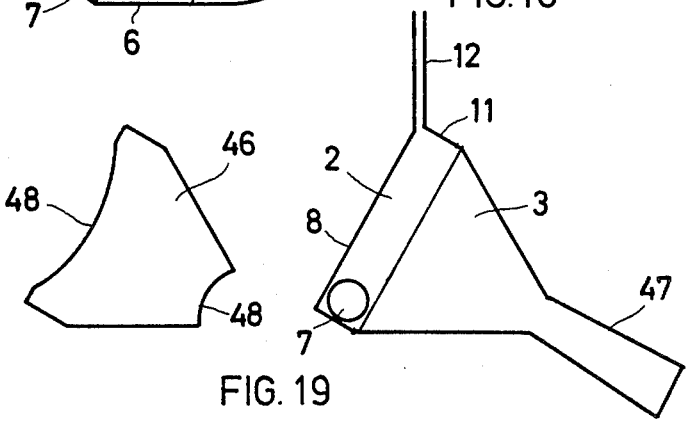
FIG. 19 is a cross-section through a further embodiment.

In the embodiment shown in FIG. 19 a partition 46 is provided for insertion into the vortex chamber. This partition can be used as a flushing member after removing cover 8 and has the function of preventing the formation of a vortex within the chamber if supply or discharge lines have to be flushed with the full flow velocity without the latter being reduced by the start of a vortex.

Flushing member 46 has on the edge facing outlet nozzle 47 and the edge facing chamber cover 8 a notch 48, both notches serving for the passage of water between the two halves of the chamber separated by member 46. In this embodiment there is no central venting port because the short outlet nozzle 47 widened in diffuser-like manner permits a rearwards ventilation of the vortex core. Conversely a central ventilation is advantageous if the outlet nozzle is constructed as a long pipe or is connected to such a pipe which makes difficult or impossible a rearward ventilation and consequently the formation of a vortex core. In addition, the central venting port serves for the intake of air when the vortex chamber simultaneously serves as an air pump.

Figure 20:
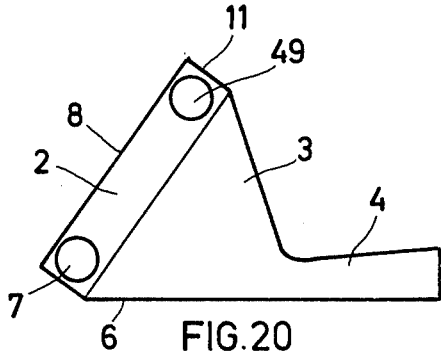
FIG. 20 is a side view of a further embodiment.
Figure 21:
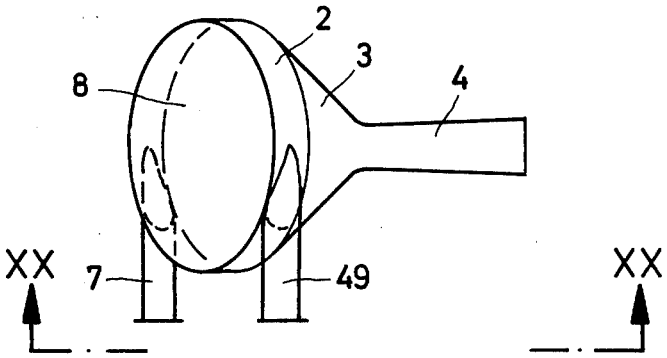
FIG. 21 is the embodiment of FIG. 20 in plan view.

In the embodiment shown in FIGS. 20 and 21, an upper inlet nozzle 49 is provided, which is parallel to the lower inlet nozzle 7 and which issues into chamber 1 with an opposite rotation direction. Until the start of the vortex, inlet nozzle 49 serves as an eccentric venting port. The feed line for inlet nozzle 49 can issue into a head race tank at a level which is above the highest point of the vortex chamber and which is not generally exceeded by the liquid level. If the liquid level in the head race tank rises then the flow through the vortex chamber also rises until the pressure at inlet nozzle 7 is sufficient to permit the start of the vortex in the chamber. With a further rise in the liquid level in the head race tank the flow through the vortex chamber slowly increases. As soon as the level reaches the entry point for the feed line for inlet nozzle 49 and passes beyond the same the additional flow of liquid moves through inlet nozzle 49 into vortex chamber 1, but said flow is in the direction opposite to that through inlet nozzle 7. This leads to a deceleration of the vortex until it collapses. The water is able to leave the vortex chamber in substantially uncontrolled manner which leads to a sudden rise in the flow rate. The control curve of the vortex chamber can be multiplied several times by arranging a plurality of pairwise oppositely directed inlet nozzles.

I claim:

1. A vortex chamber valve for liquids flowing from a head race, comprising:

a conical vortex chamber in the form of a funnel, having a longitudinal axis assuming an angle to the vertical which is greater than 30°, having a substantially central outlet nozzle and having a substantially flat chamber face cover;

at least one inlet nozzle disposed substantially tangentially into the chamber in the vicinity of the lowest point of the largest cross-sectional area of said chamber; and, an eccentrically arranged venting port disposed in the vicinity of the highest point of the chamber and having a feed line extending above the level of the head race.

2. A valve according to claim 1, wherein the cone axis assumes an angle of approximately 45° to 90° with respect to the vertical.

3. A valve according to claim 1 wherein the vortex chamber has a funnel-shaped section, and is inclined in such a way relative to the vertical that the lowest surface line of the funnel-shaped section of the vortex chamber is substantially horizontal.

4. A valve according to claim 1, wherein the internal diameter of the outlet nozzle is in a ratio of 0.5 to 2:1 relative to the internal diameter of the inlet nozzle.

5. A valve according to claim 1, wherein the diameter of the venting port is the same as, or smaller than the diameter of the inlet nozzle.

6. A valve according to claim 1, wherein the vortex chamber is tapered at a constant rate from its area of largest cross-section in the direction of the outlet nozzle.

7. A valve according to claim 1, wherein the chamber has a cone angle which is approximately 40° to 135° and preferably approximately 60° to 90°.

8. A valve according to claim 1, wherein the ratio of the diameter of the outlet nozzle to the largest diameter of the chamber is approximately 1:3 to 1:10 and preferably approximately 1:4 to 1:8.

9. A valve according to claim 1, wherein the largest diameter of the chamber is approximately 0.1 meters to 5 meters, and preferably approximately 0.5 meters to approximately 2 meters.

10. A valve according to claim 1, wherein the at least one tangential inlet nozzle is disposed substantially horizontally into the chamber.

11. A valve according to claim 1, wherein said chamber has a funnel-shaped section, and a section having a substantially constant cross-section connecting said funnel-shaped section to said chamber face cover, said connecting section being preferably cylindrical.

12. A valve according to claim 11, wherein the width of said connecting section is substantially the same as the diameter of the inlet nozzle.

13. A valve according to claim 1, wherein the chamber face cover is connected to the chamber by an edge having a rounded cross-section and being preferably curved in accordance with the diameter of the inlet nozzle.

14. A valve according to claim 1, further comprising an edge which connects the chamber face cover with the chamber, through which edge the inlet nozzle is disposed.

15. A valve according to claim 1, wherein the tangential inlet nozzle is disposed perpendicularly to a projection of the cone axis on a horizontal line.

16. A valve according to claim 1, wherein the outlet nozzle is a tubular member which is preferably widened in diffuser-like manner.

17. A valve according to claim 1, further comprising a preferably variable orifice between the vortex chamber and the outlet nozzle.

18. A valve according to claim 1, wherein the outlet nozzle is disposed substantially horizontally.

19. A valve according to claim 1, wherein the chamber face cover is disposed perpendicularly to the cone axis.

20. A valve according to claim 1, wherein the vortex chamber is axially symmetrical.

21. A valve according to claim 1, further comprising a rounded transition section between the funnel-shaped section and the outlet nozzle.

22. A valve according to claim 1, wherein the chamber face cover has a substantially central opening for venting.

23. A valve according to claim 1 wherein the feed line for the eccentric venting port is guided to the head of a tail race and terminates in the vicinity of the desired height of the tail race with a downwardly directed opening.

24. A valve according to claim 1, further comprising a plurality of oppositely directed tangential inlet nozzles.

25. A valve according to claim 24, wherein the eccentric venting port is an upper tangential inlet nozzle which issues into the chamber in the opposite rotational direction to the lower inlet nozzle.

26. A valve according to claim 1, wherein a vortex of the liquid in the chamber can be commenced and/or terminated by means for varying the gas pressure at the eccentric venting port, said means including addition of compressed air or removal of air by suction.

* * * * *